US005276284A

United States Patent [19]

Carpenter

[11] Patent Number: 5,276,284

[45] Date of Patent: Jan. 4, 1994

[54] POWER SWITCH DISABLER

[75] Inventor: Randy W. Carpenter, Union County, N.C.

[73] Assignee: Square D Company, Palatine, Ill.

[21] Appl. No.: 843,813

[22] Filed: Feb. 28, 1992

[51] Int. Cl.[5] ..... H01H 9/20

[52] U.S. Cl. ..... 200/50 A

[58] Field of Search ..... 200/50 A, 200, 61.62–61.82

[56] References Cited

U.S. PATENT DOCUMENTS

| | | | |
|---|---|---|---|
| 3,581,032 | 5/1971 | Christensen | 200/50 A |
| 3,609,261 | 9/1971 | Rys | 200/50 A |
| 5,019,676 | 5/1991 | Heckenkamp | 200/50 A |

*Primary Examiner*—J. R. Scott

*Attorney, Agent, or Firm*—Larry I. Golden; David R. Stacey

[57] ABSTRACT

A power switch disabler (10) for disable a power switch (12) provided for the energization and de-energization of electrical equipment contained within a housing (18). The power switch disabler (10) includes a housing (18) provided with an access opening (20) and associated access door (22). The access door (22) is provided with a latch (24) for securing the door (22) in a closed position. A pivoting arm (26) is fixed to one end a pivot pin (30) on the outside of the housing (18), and an engagement arm (36) is fixed to a second end of the pivoting pin (30) on the interior of the housing (18). One end of the engagement arm (36) is configured such that when the latch (24) is moved to the locked position, unselected opening of the access door (22) will be prevented. A switch (12) which incorporates a defeat lever (14) is provided for the energization and de-energization of at least one electrical component protected by the housing (18). A switch enabler (51) is provided for engaging the defeat lever (14) for selectively enabling and disabling the switch (12). The switch enabler (51) is connected between the engagement arm (36) and the defeat lever (14) such that as the latch (24) is opened, the switch (12) will be disabled, and as the latch (24) is closed, the switch (12) will be enabled.

4 Claims, 1 Drawing Sheet

POWER SWITCH DISABLER

TECHNICAL FIELD

This invention relates to the field of housings for electrical components. More specifically, this invention relates to a safety device for preventing the operation of electrical equipment such as transformers while an access door is open.

BACKGROUND ART

In the field of the operation of electrical equipment, it is well known that many accidents occur when contact is made with such equipment by foreign objects. When those foreign objects are humans or animals, serious injury or even death may result. In these and other instances, the electrical equipment may sustain substantial damage, if not total damage. In an effort to prevent such accidents, several different housings have been designed to prevent the electrical components from making such injurious contact. However, while such housings may prevent many accidents, it is still the case that the housings may be opened and the electrical components accidently contacted.

Therefore, it is an object of this invention to provide a means for disabling the electrical equipment enclosed within a housing when an access opening of the housing is open.

Another object of the present invention is to provide a means whereby the locking means of an access door must be in the locked position in order to allow for the energization of the electrical equipment contained within.

DISCLOSURE OF THE INVENTION

Other objects and advantages will be accomplished by the present invention which serves to disable a power switch provided for the energization and de-energization of electrical equipment contained within a housing. In the preferred embodiment the power switch disabler is designed to disable the power switch as an access panel latch is opened, thereby preventing the energization of the electrical equipment until the access panel is closed and the latch is returned to the locked position, while allowing the equipment to remain energized if the latch is opened during operation. The housing is provided with an access opening and associated access door pivotally connected about one side to the housing.

The access door is provided with a latch for securing the door in a closed position. A pivoting pin is carried by the access door. A pivoting arm is fixed to one end on the outside of the housing, and an engagement arm is fixed to a second end of the pivoting pin on the interior of the housing. The first end of the engagement arm is configured such that when the latch is moved to the locked position, the housing wall will be received between the engagement arm and the access door, thereby preventing the unselected opening of the access door. Stop members may be provided for limiting the pivoting arm motion. Cooperating openings may be defined by the pivoting arm and the stop member for receiving a locking means such as a padlock for deterring unauthorized entry into the housing.

A switch is provided for the energization and de-energization of the electrical components protected by the housing. The switch is a conventional type which includes a defeat lever for disabling the switch itself.

The defeat lever is biased in the OFF position, i.e., when the defeat lever is not engaged, the switch is disabled. The switch is carried by the exterior of the housing for the selective energization and de-energization of the electrical equipment. At least a portion of the defeat lever is received within the interior of the housing to prevent tampering.

A switch enabling means is provided for engaging the defeat lever for selectively enabling and disabling the switch. A linkage rod is provided for extending from the second end of the engagement arm toward the switch. A guide is provided for maintaining the vertical position of the second end of the linkage rod, the second end of the linkage rod being otherwise free to move in an axial direction. The second end of the linkage rod is positioned to selectively engage a cam which is connected to the housing such as to pivot freely in a vertical plane. When the access door latch is in the closed position, the second end engages the cam. However, when the latch is opened, the second end of the linkage rod is withdrawn from engagement. A biasing means is provided for retracting the second end of the linkage rod when the defeat lever is selectively disengaged. The biasing means may include a spring attached between the second end of the linkage rod and the guide. The biasing means also serves to withdraw the linkage rod from engagement with the cam when the access door latch is partially opened. A notch is defined in the cam for the engagement of the linkage rod, which may include an elbow extending at a substantial right angle for engaging a portion of the notch defined by the cam.

A defeat lever engagement rod is pivotally connected at one end to a radial edge of the cam and at an opposing end to the defeat lever of the switch. As the second end of the defeat lever engagement rod is moved downwardly, in the embodiment illustrated in the figures, it will be seen that the defeat lever will be likewise moved in an downward direction and the switch will thus be enabled.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
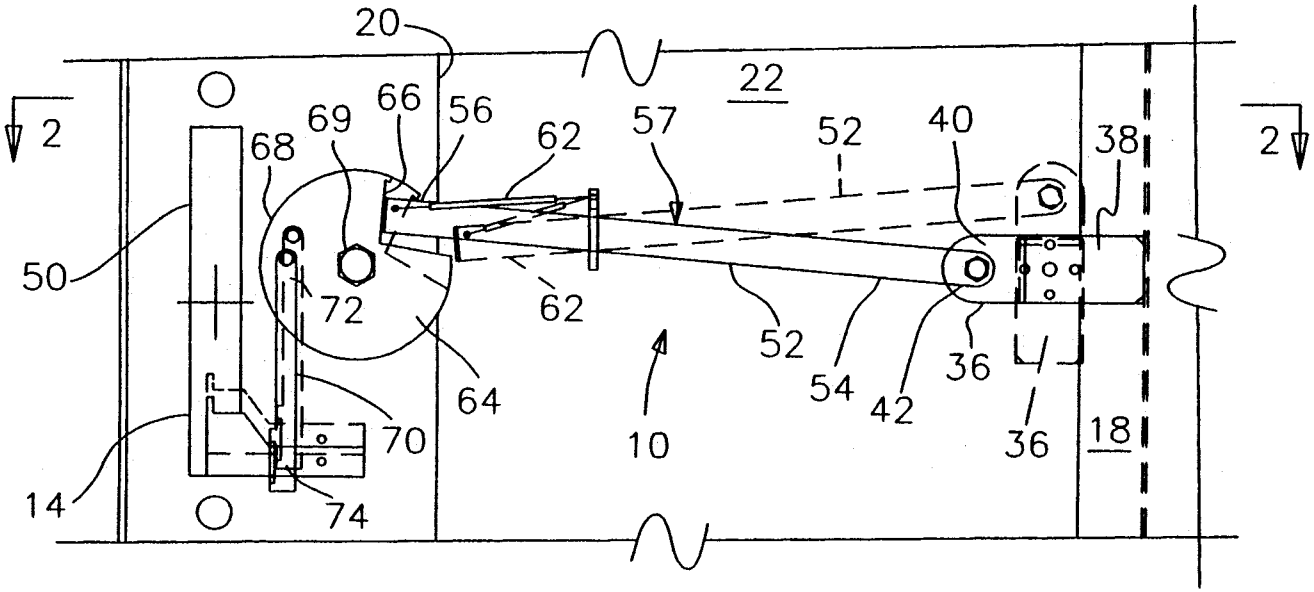
FIG. 1 is an elevation view of the power switch disabler constructed in accordance with several features of the present invention.

A power switch disabler incorporating various features of the present invention is illustrated generally at 10 in the figures. The power switch disabler 10 is designed for disabling a power switch 12 provided for the energization and de-energization of electrical equipment contained within a housing 18. In the preferred embodiment the power switch disabler 10 is designed to disable the power switch 12 as an access door latch 24 is opened, thereby preventing the energization of the electrical equipment until the access door 22 is closed and the latch 24 is returned to the locked position. If the electrical equipment is energized when the access door 22 is opened, it will remain energized until the switch 12 is selectively turned off.

In the preferred embodiment, the power switch disabler 10 is used in cooperation with a housing 18 designed to enclose selected electrical equipment, such as a transformer. The housing 18 is provided with an access opening 20 and an access door 22 for substantially covering the access opening 20, the access door 22 being pivotally connected about one side to the housing 18 by a pivot hinge 16.

The door 22 is typically provided with a latch 24 for securing the door 22 in a closed position. As shown in the figures, the latch 24 of the preferred embodiment includes a pivoting arm 26 which pivots about one end 28. A pivoting pin 30 is carried by the access door 22 and received within the pivoting arm end 28 such that movement is substantially limited to rotation about its longitudinal axis. Movement along the longitudinal axis is limited in a direction toward the electrical components within the housing 18 at least by the pivoting member 26. It will be seen that movement along the longitudinal axis of the pivoting pin 30 is limited in an opposite direction by components to be described below. Other conventional means may be used to further limit the axial movement of the pivoting pin 30 as required. The range of motion of the pivoting arm 26 may vary, but in the preferred embodiment, the pivoting arm 26 pivots substantially ninety degrees (90°).

Stop members 46 may be provided for limiting the pivoting arm motion in at least one selected direction. As shown, a stop member 46 is provided in the preferred embodiment to limit the motion of the pivoting arm 26 when the pivoting arm 26 is moved to the locked position. Cooperating openings 44,48 may be defined by the pivoting arm 26 and the stop member 46, respectively, for receiving a locking means (not shown) such as a padlock for deterring unauthorized entry into the housing 18.

An engagement arm 36 is fixed to a second end 34 of the pivoting pin 30. The first end 38 of the engagement arm 36 is configured such that when the latch 24 is moved to the locked position, the housing 18 will be received between the engagement arm 36 and the access door 22, thereby preventing the unselected opening of the access door 22. It will be seen that it will be necessary to configure the engagement arm 36 such that as the latch 24 is moved to the open position, the access door 22 may be freely and selectively opened without interference of the engagement arm 36.

A switch 12 is provided for the energization and de-energization of at least one electrical component protected by the housing 18. The switch 12 is a conventional type which includes a defeat lever 14 for disabling the switch 12 itself. The defeat lever 14 is biased in the OFF position, i.e., when the defeat lever 14 is not engaged, the switch 12 is disabled. As shown in the figures, and as will be further described below, the defeat lever 14 of the preferred embodiment is biased upwardly. It will be understood, of course, that the arrangement may be reversed or otherwise modified to attain the same result. Further, as illustrated in the figures, the switch 12 is carried by the exterior of the housing 18 for the selective energization and de-energization of the electrical equipment. At least a portion of the defeat lever 14 is received within the interior of the housing 18 through an opening 50 defined by the housing 18. Thus, the defeat lever 14 cannot be tampered with.

A switch enabling means 51 is provided for engaging the defeat lever 14 for selectively enabling and disabling the switch 12. In the preferred embodiment, a second end 40 of the engagement arm 36 defines an opening 42 for pivotally attaching the first end 54 of a linkage rod 52. A guide 60 is provided for maintaining the vertical position of the second end 56 of the linkage rod 52, the second end 56 of the linkage rod 52 being otherwise free to move in an axial direction. The second end 56 of the linkage rod 52 is positioned to selectively engage a cam 64. It will be seen from FIG. 1 that when the access door latch 24 is in the closed position (shown in solid lines), the second end 56 engages the cam 64. However, when the latch 24 is opened, the second end 56 of the linkage rod 52 is withdrawn from engagement.

Figure 2:
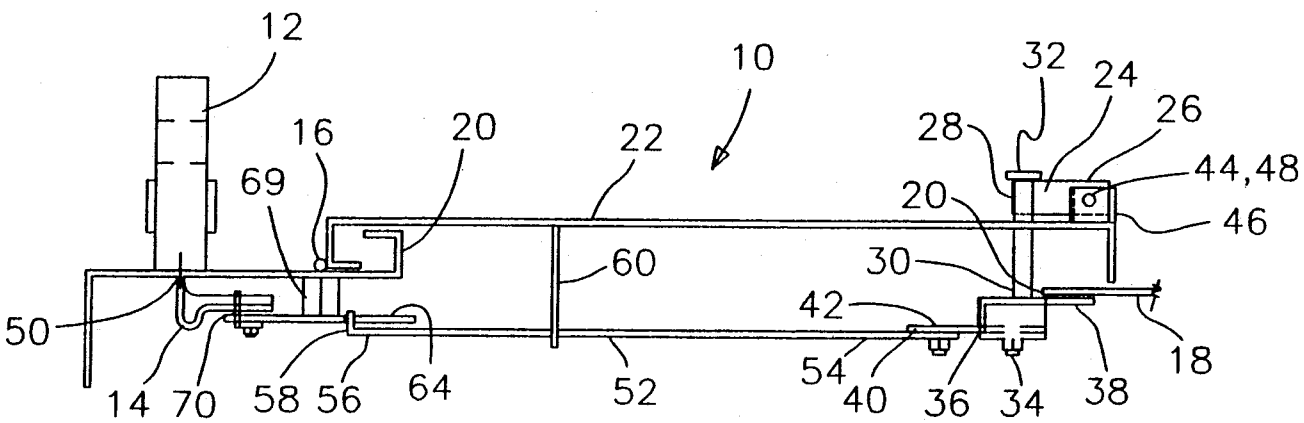
FIG. 2 illustrates a top plan view, in section, of the power switch disabler taken at section line 2—2 of FIG 1.

A biasing means 62 is provided for retracting the second end 56 of the linkage rod 52 when the defeat lever 14 is selectively disengaged. This retraction may be desirable in configuration such as that depicted in FIG. 2 where the second end 56 of the linkage rod 52 may interfere with the normal operation of the access door 22 during opening and closing. As shown in the figures, the biasing means 62 may include a spring attached between the second end 56 of the linkage rod 52 and the guide 60. The biasing means 62 also serves to withdraw the linkage rod 52 from engagement with the cam 64 when the access door latch 24 is partially opened. Thus, the biasing means 62 limits the range of motion of the engagement arm 36, and subsequently the latch 24, in the open position. It will be seen that when the latch 24 is in the locked position, the biasing means 62 serves no function.

The cam 64 is pivotally connected to the housing 18. As shown in the figures, the cam 64 defines a circular plate configuration. A notch 66 is defined in the cam 64 for the engagement of the linkage rod 52. As depicted, the linkage rod 52 may include an elbow 58 extending at a substantial right angle for engaging a portion of the notch 66 defined by the cam 64. The cam 64 is attached to the housing 18 such that free rotation about a centrally located pivoting pin 69 is attained. It will be understood that the cam 64 may be of any conventional configuration in order to achieve similar results.

A defeat lever engagement rod 70 is pivotally and eccentrically connected at one end 72 to a radial edge 68 of the cam 64. The second end 74 of the defeat lever engagement rod 70 is connected to the defeat lever 14 for selectively enabling and disabling the switch 12. As the second end 74 of the defeat lever engagement rod 70 is moved downwardly, in the embodiment illustrated in the figures, it will be seen that the defeat lever 14 will be likewise moved in an downward direction and the switch 12 will thus be enabled.

The power switch disabler 10 is intended to be used to insure that the operation of at least one electrical component may not be initiated if an access door latch 24 is in the open position. As illustrated and described, the door latch 24 may pivoted in a selected direction to open or close the access door 22, and respectively to disable and enable the power switch 12. In the embodiment illustrated in the figures, a latch 24 is provided on the exterior of the door 22. As the latch 24 is rotated, an engagement arm 36 fixed to the latch 24 is simultaneously rotated. When the engagement arm 36 is rotated counterclockwise in the view of FIG. 1, the latch 24 is closed, and the second end 56 of a linkage rod 52 is forced into engagement with a cam 64. The cam 64 is in turn rotated in reaction to such engagement, and a defeat lever engagement rod 70 is pushed in a direction tangent to the rotation of the cam 64. The defeat lever engagement rod 70 is eccentrically and pivotally connected to the cam 64 at one end 72, and is connected at the other end 74 to the defeat lever 14 of a power switch 12. As the defeat lever engagement rod 70 is displaced, the defeat lever 14 is likewise displaced, thus enabling the power switch 12. The power switch 12 may then be selectively used for normal operation.

When the engagement arm 36 is rotated in a clockwise direction in the view of FIG. 1, the latch 24 is opened, and the second end 56 of the linkage rod 52 is retracted from engagement with the cam 64. The defeat lever 14, being biased in a direction to disable the power switch 12, will then return to a position to disable the switch 12 in reaction to release of the force of the linkage rod 52. The defeat lever engagement rod 70 will be moved in a substantially similar direction, and the cam 64 will likewise be rotated in reaction to the movement of the defeat lever engagement rod 70.

From the foregoing description, it will be recognized by those skilled in the art that a power switch disabler offering advantages over the prior art has been provided. Specifically, the power switch disabler provides a means whereby the power switch controlling the operation of electrical equipment such as a transformer may be automatically disabled upon the opening of an access door latch. If the electrical equipment is energized when the latch is opened, the power switch disabler will serve to disable the power switch. The equipment will remain energized unless the power switch is turned off. However, the equipment cannot be re-energized until the access door is closed and the latch moved to the locked position.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A power switch disabler for disabling a power switch incorporated into a housing for shielding at least one electrical component, said housing having an access opening and an access door for selectively covering the access opening, said power switch disabler comprising:

a latch for selectively latching said access door in a closed position, said latch including a pivoting pin received through and substantially perpendicular to said access door, said pin having a first end outboard of, that is, exterior to, said housing, and a second end within the interior of said housing, said latch further including an engagement arm fixed to said second end of said pin and having a first end for cooperating with said housing to perform said latching function when said pin is selectively pivoted;

a power switch for selectively energizing said electrical component, said switch including a defeat lever for preventing the closing of the switch and thereby the energizing of the electrical component unless said defeat lever is engaged, said defeat lever being biased in the switch-disabled position, at least a portion of said defeat lever being positioned within the interior of said housing;

disabling means for disabling said power switch from being closed when said access door latch is in an unlatched position;

said disabling means including a linkage rod having a first end pivotally secured to a second end of said engagement arm and a second end for selectively engaging a cam in response to axial movement of said linkage rod and a defeat lever engagement rod having a first end pivotally connected to said cam and a second end for selectively engaging said defeat lever of said power switch;

whereby when said access door is closed and said latch is in the latched position said defeat lever is engaged and said power switch can be closed to energize said electrical component; and whereby when said latch is in the unlatched position said defeat lever is not engaged by said defeat lever engagement rod and said power switch cannot be closed to energize said electrical component.

2. The power switch disabler of claim 1 wherein said latch further comprises a lock for locking said access door in the closed and latched position.

3. The power switch disabler of claim 1 wherein said disabling means further comprises a guide for selectively limiting the non-axial movement of the linkage rod.

4. The power switch disabler of claim 1 wherein said disabling means further comprises biasing means for selectively retracting the second end of the linkage rod from engagement with the cam when the defeat lever is not engaged.

* * * * *